United States Patent [19]

Hammond

[11] 4,287,632

[45] Sep. 8, 1981

[54] RETAINING MEANS FOR MOP HEAD

[75] Inventor: Dennis A. Hammond, Ottawa, Canada

[73] Assignee: Dustbane Enterprises Limited, Ottawa, Canada

[21] Appl. No.: 136,499

[22] Filed: Apr. 3, 1980

[30] Foreign Application Priority Data

Jan. 18, 1980 [CA] Canada ..... 343939

[51] Int. Cl.[3] ..... A47L 13/258

[52] U.S. Cl. ..... 15/150

[58] Field of Search ..... 15/147 R, 150, 228, 15/229 R, 229 A

[56] References Cited

U.S. PATENT DOCUMENTS

| | | | |
|---|---|---|---|
| 1,267,398 | 5/1918 | Gavin | 15/150 X |
| 1,376,175 | 4/1921 | Sundermann | 15/150 |
| 1,664,824 | 4/1928 | Koekov | 15/147 R |
| 1,762,454 | 6/1930 | Poulos | 15/150 |
| 2,900,652 | 8/1959 | Kautenberg | 15/150 X |
| 3,688,331 | 9/1972 | Saltzstein | 15/229 A |

*Primary Examiner*—Chris K. Moore

*Attorney, Agent, or Firm*—Burke-Robertson, Chadwick & Ritchie

[57] ABSTRACT

A pivoting jaw retaining means for a yarn-type wet mop head, the main parts of which may be integrally moulded from appropriate plastic material and which has few moving parts. The retaining means has an elongated body provided with opposite spaced first and second terminal extensions downwardly extending from the ends of the body. One end of the jaw is pivotably secured to the lower free end of the first extension. The other end of the jaw and the inside surface of the lower end of the second extension are provided with releasably co-operating engagement means. When in engaged position the jaw and the body are in spaced parallel orientation. The second terminal extension also extends upwardly from the corresponding end of the body. The second terminal is pivotably associated between its ends with the body for outward movement of the lower free end of the second terminal extension away from the jaw. The retaining means is further provided with a semi-rigid release bar. One end of the release bar is attached to the shank at a point spaced from the body. The other end of the release bar is attached to the upper end of the second terminal extension. Downward pressure on a part of the release bar between its ends causes deflection of the release bar to pivot the second terminal extension and consequently move the free end of the terminal extension away from the jaw to release the engagement means when in position and permit the jaw to open. Removal of that downward pressure causes the release bar and the second terminal extension to return to original positions to permit re-engagement of the engagement means when the jaw is to be closed.

12 Claims, 2 Drawing Figures

RETAINING MEANS FOR MOP HEAD

BACKGROUND OF THE INVENTION

This invention relates to a retaining means for a yarn-type wet mop head, and more particularly relates to a pivoting jaw type of retaining means.

With increasing costs of materials, and a desire to minimize such costs particularly in industrial or commercial cleaning services, it is a common practice to use retaining means which will permit replacing mop heads on their support handles. This enables removal of the mop head for cleaning, or for replacement when worn or no longer usable. In this way a common handle and retaining means for the mop head is provided for a sequence of mop heads.

The present invention relates to a mop head retaining means for a yarn-type wet mop head of the type having a shank for connection to a mop handle, an elongated body secured at its middle to the shank and a jaw cooperating with and pivoting with respect to the body to releasably grip and retain the mop head yarn between the jaw and the body. Know constructions of this general type are described for example in U.S. Pat. No. 3,457,581 of Oas issued July 29, 1969; U.S. Pat. No. 3,735,441 of Shortte, Jr. issued May 29, 1973; U.S. Pat. No. 2,568,218 of Campbell issued Sept. 18, 1951; U.S. Pat. No. 3,398,420 of Manning issued Aug. 27, 1968; U.S. Pat. No. 3,681,810 of Vosbikian, Jr. issued Aug. 8, 1972; U.S. Pat. No. 2,442,843 of Comito issued June 8, 1948; Canadian Pat. No. 530,706 of Trindl issued Sept. 25, 1956; Canadian Pat. No. 16,174 of Lee issued 1883; Canadian Pat. No. 85,266 of Doeblin issued Feb. 9, 1904; Canadian Pat. No. 214,131 of Sundermann, Jr. issued Nov. 8, 1921; Canadian Pat. No. 256,272 of Hashimoto issued Dec. 15, 1925 and Canadian Pat. No. 637,116 of Friar issued Feb. 27, 1962.

Many of these constructions require fairly complicated mechanical means for securing the free end of the jaw to the main body of the retaining means. These constructions often require metal components which tend with time to corrode and reduce efficient operation of the jaw release mechanisms and the jaw themselves. The more moving parts such devices have, the more such problems are compounded. Because of the nature of the jaw securing means for such prior art devices, the jaws are often times constructed with curved or bent ends which require some handling or manipulation of the mop head yarns when inserting or removing the mop head. Such constructions may require the user to actually handle the mop yarns in order to remove them from the open jaw—a task which may be unpleasant or distasteful. One such prior art mop holder which does not have such a problem is described in U.S. Pat. No. 3,457,581 of Oas. There a straight, elongated jaw is pivotably attached at one end to an elongated body, and is secured at the other end by a knob-like fastener which fits into a slot in the side of a corresponding portion of the body. While the straight jaw of this Oas device permits the jaw to be opened and the mop yarn to be removed with no obstructions, the knob-like fastener requires a certain degree of manipulation by the user for fastening and unfastening of that free end of the jaw. It is also exposed, as are the jaw fasteners of the previously referred to devices, such that it would be subjected to knocks and bumps from furniture, etc., during use which might tend to dislodge such fasteners and unintentionally open the jaw such that the mop head yarns would be released.

Other references of background interest are U.S. Pat. No. 3,074,092 of Siemund issued Jan. 22, 1963 and U.S. Pat. No. 4,006,509 of Chase issued Feb. 8, 1977 which patents illustrate other constructions of jaw-type retainers for yarn-type mop heads.

Consequently an object of the present invention is to provide a pivoting jaw retaining means for a yarn-type wet mop head which may be preferably made of non-corrosive plastic components and which permits ready insertion and removal of the mop head with minimal user contact and manipulation. It is a further object of the present invention to provide such a retainer having a straight jaw to enable ready removal of the yarn, while at the same time providing a jaw release mechanism which is both difficult to unintentionaly operate for disengagement, and which is aethestically pleasing to the eye.

SUMMARY OF THE INVENTION

According to the present invention a pivoting jaw retaining means for a yarn-type wet mop head is provided having a shank for connection to a mop handle, an elongated body secured at its middle to the shank and a jaw is operating with respect to the body to releasably grip and retain the mop head yarn between the jaw and the body and release it therefrom. The main parts of the retaining means may be integrally moulded from appropriate plastic material. The body is provided with opposite spaced first and second terminals extension downwardly extending from the ends of the body. One end of the jaw is pivotably secured to the lower free end of the first extension. The other free end of the jaw and the inside surface of the lower end of the second extension are provided with co-operating engagement means releasable upon spacing apart of the lower end of the second extension and the free end of the jaw in a direction generally normal to the direction of rotation of the latter at its closed position. When in engaged position the jaw and the body are in spaced parallel orientation. The second terminal extension also extends upwardly from the corresponding end of the body. The second terminal is pivotably associated between its ends with the body for outward movement of the lower free end of the second terminal extension away from the jaw. The retaining means is further provided with a semi-rigid release bar. One end of the release bar is attached to the shank at a point spaced from the body. The other end of the release bar is attached to the upper end of the second terminal extension. Downward pressure on a part of the release bar between its ends causes deflection of the release bar to pivot the second terminal extension and consequently move the free end of the terminal extension away from the jaw to release the engagement means when in position and permit the jaw to open. Removal of that downward pressure causes the release bar and the second terminal extension to return to original positions to permit re-engagement of the engagement means when the jaw is to be closed.

The release bar is preferably shielded against unintentional deflection, for example if the retaining means were bumped during use, by a rigid security bar secured to the shank and extending towards the upper end of the second terminal extension. The release bar is positioned between that security bar and the body.

The pivoting jaw retaining means according to the present invention provides a mechanism having few moving parts, being made essentially of integral construction from non-corroding materials such as plastics. The construction permits use of a straight jaw with the advantage that, upon release of the jaw engagement means, the mop head can be dropped directly, for example into a pail of water, with little or no contact or manipulation of that mop head by the user. The jaw mechanism permits reliable simple release and closing the jaw by the user with a single motion unlike prior art devices, many of which have required cranking, twisting, turning or other types of manipulation to secure the jaw in closed position or to release the jaw from that position. The release means is simple to construct and operate and shielded against unintentional actuation.

BRIEF DESCRIPTION OF THE DRAWINGS

These and other objects, will be readily evident, upon a study of the following specification, and the accompanying drawings, wherein.

Figures 1, 2:
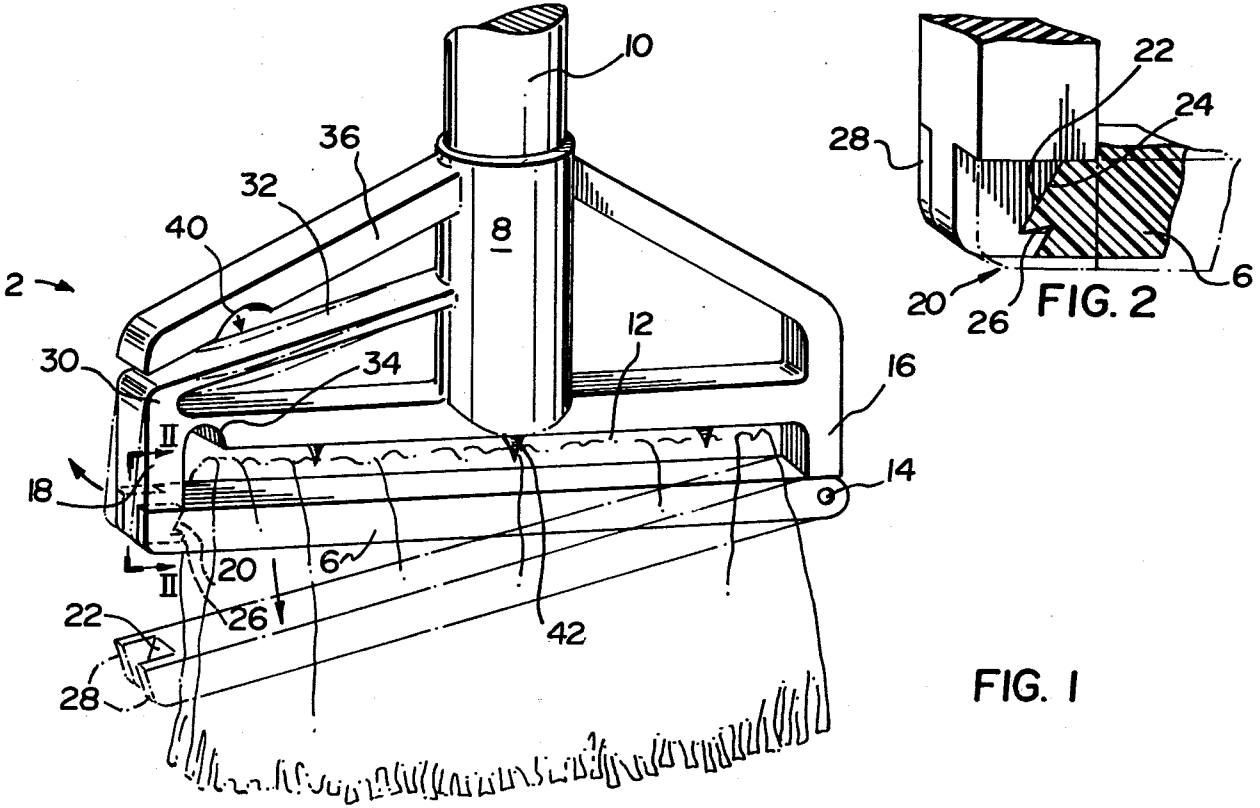
FIG. 1 is a perspective view of a pivoting jaw retaining means for a yarn-type wet mop head in accordance with the invention.
FIG. 2 is a detail view of the jaw engagement means of the retaining means of FIG. 1.

While the present invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Turning to FIG. 1 there is shown a retaining means 2 for a yarn-type wet mop head 4 having a pivoting jaw 6. The retaining means has a socketed shank 8 by which mop handle 10 is connected, and an elongated body 12. Jaw 6 pivots with respect to the body at 14 and releasably grips and retains mop head 4 between it and body 12. Body 12 is further provided with opposite spaced terminal extensions 16 and 18, downwardly extending from the ends of body 12. Pivot 14 is located towards the lower free end of extension 16.

As can be best seen in FIG. 2, releasable engagement means 20 are provided at the free end of jaw 6 and the inside surface of the lower end of extension of 18 such that, when in engaged position as shown in FIG. 1, jaw 6 and body 12 are in spaced parallel orientation. Engagement means 20 is made up of a nose-shaped extension 22 on the free end of jaw 6, and a corresponding angled wall 24 and outwardly extending ledge 26 on the inside surface of the lower end of terminal extension 18, nose 22 releasably co-operating with angled wall 24 and ledge 26 when in engaged position. As can be seen in FIG. 2, the lower portion of nose-shaped extension 22 and the upper surface of upwardly extending ledge 26 are angled with respect to horizontal, to provide a positive resistance against disengagement of the jaw when in closed or engaged position. Spaced walls 28 are secured to the jaw on each side of nose-shaped extension 22 whereby, when the jaw is in closed position, the jaw fits on opposite sides of the lower end of extension 18 and these walls resist lateral displacement of the jaw.

It will be noted that extension 18 is provided with an upward extension 30, to which is secured one end of a semi-rigid release bar 32. The other end of release bar 32 is attached to shank 8 at a point spaced from body 12. Terminal extension 18 is secured to body 12 in such a way that it will pivot with respect thereto to permit outward movement of its lower free end away from jaw 6. In the illustrated embodiment, the pivot function of terminal extension 18 is provided by narrowing the depth of the body 12 at 34.

A rigid security bar 36 is secured to shank 8 and extends towards and almost to the upper end 30 of terminal extension 18. In this way release bar 32 is shielded between security bar 36 and body 12 against unintentional deflection. A notch 40 is provided in security bar 36 to guide the user to the most appropriate position to apply pressure to release bar 32.

In operation, when the jaw is in engaged position with respect to terminal extension 18, and it is desired to open that jaw for example to replace mop head 4 with a new mop head, release bar 32 is simply pressed in the vicinity of notch 40, and deflected, as shown in FIG. 1. Deflection of release bar 32, draws upper end 30 of terminal extension 18 inwardly and causes the lower end of terminal extension 18, and consequently its angled wall 24 and ledge 26 to move outwardly as terminal extension 18 pivots about neck 34 (see phantom in FIG. 1). When ledge 26 clears the end of nose 22, jaw 6 is free to pivot about pivot 14 enabling the old mop head 4 to fall from jaw 6. When a new mop head 4 is placed on jaw 6, the jaw is simply pivoted back into engaged position with nose 22 mating with angled wall and outwardly extending ledge 26 of terminal extension 18. As illustrated in FIG. 2, it has been found that because of the pressures exerted on jaw 6 during use of the mop, the slight angle (e.g. 4°) given to the bottom surface of nose 22 and an even lesser angle given to upper surface of ledge 26 (e.g. 2°), with respect to the longitudinal axis of the jaw when in closed position, increases resistance against unintentional opening of the jaw. These angles, of course, must not be so great as to prevent opening of jaw 6 when release bar 32 is deflected as previously described. With applicant's construction, if abnormally greater pressures are exerted on jaw 6 when in closed position, for example, if the mop head became entangled about a furniture leg, the tip of nose 22 will still bear securely against an inner portion of the upper surface of ledge 26 even if there were slight outward flexing of jaw 6. (This would not be the case if the bottom surface of nose 22 and upper surface of ledge 26 had the same angle and thus perfectly mated when in closed position. Pressure which caused slight outward flexing of jaw 6 would then cause the tip of nose 22 to lift from its position bearing on an inner portion of the upper surface of ledge 26, tending to open the jaw.)

It will be noted from the drawings that terminal extension 18 is secured to elongated body 12 at a point near the upper end of the terminal extension and the lower end thereof. Such a positioning of terminal extension 18 will be understood, from basic leverage principles, to enable its lower end to swing a greater distance away from the free end of jaw 6 when release bar 32 is deflected upon application of downward pressure.

The mop head retaining means according to the present invention may be made of any appropriate material. In order to avoid corroding parts, a preferred construction would be to mould integrally the shank, body, terminal extensions, release bar and security bar integrally from a plastic such as polythylene. A polythylene jaw could be pivoted by a polycarbonate rod on terminal extension 16. The inner surface of body 12 is preferably provided with teeth 42 to assist in gripping the mop head when the jaw is in closed position. Such teeth are not provided on the inner surface of jaw 6 so that the mop head will easily slide off jaw 6 when open.

While the engagement means 20 described and illustrated herein is a preferred form, it is not intended to limit the present invention to such form of engagement means as other constructions obvious to one skilled in the art in view of these teachings, would also be suitable.

Thus there has been described in accordance with the invention a pivoting jaw retaining means for a yarn-type wet mop head that fully satisfies the objects, aims and advantages set forth above. While the ir vention has been described in conjunction with an example embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. In a pivoting jaw retaining means for a yarn-type wet mop head, having a shank for connection to a mop handle, an elongated body secured at its middle to the shank, and a jaw cooperating with and pivoting with respect to the body to releasably grip and retain the mop head yarn between the jaw and the body and release it therefrom, the improvement wherein: the elongated body is provided with opposite, spaced first and second terminal extensions downwardly extending from the ends of the body, one end of the jaw being pivotably secured to the lower free end of the first extension, the other free end of the jaw and the inside surface of the lower end of the second extension being provided with co-operating engagement means releasable upon spacing apart of the lower end of the second extension and the free end of the jaw in a direction generally normal to the direction of rotation of the latter at its closed position, so that when in engaged position the jaw and the body are secured in spaced parallel orientation; the second terminal extension also extending upwardly from the corresponding end of the body and being pivotably associated between its ends with the body for outward movement of the lower free end of the second terminal extension away from the jaw; the retaining means being further provided with a semi-rigid release bar, one end of which bar is attached to the shank at a point spaced from the body, the other end of which bar is attached to the upper end of the second terminal extension, whereby downward pressure on a part of the release bar between its ends causes deflection of the release bar to pivot the second terminal extension and consequently move the lower end of the terminal extension away from the jaw to release the engagement means when in closed position and permit the jaw to open, and removal of that downward pressure causes the release bar and the second terminal extension to return to original positions to permit re-engagement of the engagement means when the jaw is to be closed.

2. A retaining means according to claim 1 wherein the retaining means is further provided with a rigid security bar secured to the shank and extending towards the upper end of the second terminal extension, the release bar being positioned between the security bar and the body, whereby the release bar is shielded against unpurposeful disengagement of the engagement means by unintentional deflection of the release bar during use of the mop.

3. A retaining means according to claim 2 wherein the security bar and release bar are relatively closely situated and wherein the security bar is provided with a notch at a predetermined position in its surface facing the release bar at an appropriate position for application of pressure to the release bar to facilitate application of pressure to the release bar.

4. A retaining means according to claim 2 wherein the body, terminal extensions, release bar and security bar are integrally moulded.

5. A retaining means according to claim 1, wherein the second terminal extension is associated with the body at a point nearer the upper end of the terminal extension than the lower end thereof.

6. A retaining means according to claim 1 wherein the body and the second terminal extension are of integral construction and made from polypropylene.

7. A retaining means according to claim 6 wherein the thickness of the body in the vicinity where it is secured to the second terminal extension narrows to permit pivoting of that terminal extension.

8. A retaining means according to claim 1 wherein the engagement means comprises a nose-shaped extension on the free end of the jaw and a corresponding angled wall and outwardly extending ledge on the inside surface of the lower end of the second extension to provide confronting, co-operating releasably engaging surfaces.

9. A retaining means according to claim 8 wherein spaced walls are secured to the jaw on each side of the nose-shaped extension to fit on opposite sides of the lower end of the second extension and resist lateral displacement of the jaw when in engaged position with the second extension.

10. A retaining means according to claim 8 wherein the co-operating lower surface of the nose-shaped extension and upper surface of the outwardly extending ledge are slightly angled, with respect to the axis of the jaw when in closed position, to provide a positive resistance against disengagement of the engagement means, the angle of the lower surface of the nose-shaped extension with respect to the axis of the jaw, being slightly greater than the angle of the upper surface of the ledge.

11. In a pivoting jaw retaining means for a yarn-type wet mop head, having a shank for connection to a mop handle, an elongated body secured at its middle to the shank, and a jaw cooperating with and pivoting with respect to the body to releasably grip and retain the mop head yarn between the jaw and the body and release it therefrom, the improvement wherein: the elongated body is provided with opposite, spaced first and second terminal extensions downwardly extending from the ends of the body, one end of the jaw being pivotally secured to the lower free end of the first extension, the other free end of the jaw and the inside surface of the lower end of the second extension being provided with co-operating engagement means releasable upon spacing apart of the lower end of the second extension and the free end of the jaw in a direction generally normal to the direction of rotation of the latter at its closed position, so that, when in engaged position the jaw and the body are in spaced parallel orientation; the second terminal extension also extending upwardly from the corresponding end of the body and being pivotally associated between its ends with the body for outward movement of the lower free end of the second terminal extension away from the jaw, the second terminal extension being associated with the body at a point nearer the upper end of the terminal extension than the lower end thereof, the body narrowing in depth about where it is secured to the second terminal extension to permit the required pivoting of that extension; the retaining means being further provided with a semi-rigid release bar, one end of which bar is attached to the shank at a point spaced from the body, the other end of which bar is attached to the upper end of the second terminal extension, whereby downward pressure on a part of the release bar between its ends causes deflection of the release bar to pivot the second terminal extension and consequently move the lower end of that terminal extension away from the jaw to release the engagement means when in closed position and permit the jaw to open, and removal of that downward pressure causes the release bar and the second terminal extension to return to original positions to permit re-engagement of the engagement means when the jaw is to be closed.

12. A retaining means according to claim 11 wherein the retaining means is further provided with a rigid security bar secured to the shank and extending towards the upper end of the second terminal extension, the release bar being positioned between the security bar and the body, whereby the release bar is shielded against unpurposeful disengagement of the engagement means by unintentional deflection of the release bar during use of the mop.

* * * * *